US006777039B2

(12) United States Patent
Koike et al.

(10) Patent No.: US 6,777,039 B2
(45) Date of Patent: Aug. 17, 2004

(54) INKJET RECORDING SHEET

(75) Inventors: Kazuyuki Koike, Shizuoka-ken (JP); Takashi Kobayashi, Shizuoka-ken (JP); Katsuyoshi Suzuki, Shizuoka-ken (JP); Ryoichi Nakano, Shizuoka-ken (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/125,580

(22) Filed: Apr. 19, 2002

(65) Prior Publication Data

US 2003/0104175 A1 Jun. 5, 2003

(30) Foreign Application Priority Data

Apr. 19, 2001 (JP) ..... 2001-121288

(51) Int. Cl.[7] ..... B41M 5/00

(52) U.S. Cl. ..... 428/32.26; 428/32.28; 428/32.29; 428/32.3; 428/32.34; 428/32.38; 427/407.1; 427/411; 427/385.5; 427/391

(58) Field of Search ..... 427/407.1, 411, 427/385.5, 391; 428/32.26, 32.28, 32.29, 32.3, 32.34, 32.38

(56) References Cited

U.S. PATENT DOCUMENTS 6,387,473 B1 * 5/2002 Sismondi et al. ..... 428/195
2002/0064633 A1 * 5/2002 Wakata et al. ..... 428/195
2002/0176970 A1 * 11/2002 Kobayashi et al. ..... 428/195

FOREIGN PATENT DOCUMENTS

| | | |
|---|---|---|
| JP | 10-181190 | 7/1998 |
| JP | 11-115308 | 4/1999 |
| JP | 2000-21235 | 8/2000 |
| JP | 2000-211241 | 8/2000 |

* cited by examiner

*Primary Examiner*—Cynthia H. Kelly
*Assistant Examiner*—B. Shewareged
(74) *Attorney, Agent, or Firm*—Sughrue Mion, PLLC

(57) ABSTRACT

An inkjet recording sheet comprising a support and, on a surface of the support, a colorant-receiving layer formed by applying a first coating liquid, adding a second coating liquid, after application of the first coating liquid and before the same shows a decreasing rate of drying, and thereafter hardening and drying the coat layer to form a porous structure. The first coating liquid has a pH value of 5 or lower, and is obtained by adding a solution which includes polyvinyl alcohol, a nonionic surfactant and/or amphoteric surfactant and a high boiling point organic solvent, to a dispersion including a cationic resin and vapor-phase-process silica having a specific surface area of at least 200 $m^2/g$ as measured by the BET method. The second coating liquid has a pH value of 8.5 or higher and includes a cross-linking agent capable of cross-linking the polyvinyl alcohol, an organic mordant and a nonionic surfactant.

20 Claims, No Drawings

INKJET RECORDING SHEET

BACKGROUND OF THE INVENTION

1. Field of the Invention

The present invention relates to a recording material suited for inkjet recording using a liquid ink such as an aqueous ink, an oil ink, or a solid ink that has a solid state at room temperature and is used in a fused state in image printing, and particularly relates to an inkjet recording sheet excellent in ink receiving performance.

2. Description of the Related Art

In recent years, with the rapid progress of information industries, a variety of information processing systems have been developed, and recording methods and apparatuses suited for the information systems have also been developed and put to practical use.

Among the recording methods, an inkjet recording method has been widely spread, naturally, is naturally used in offices, and is used for so-called home use as well, because the method can be used on a variety of recording media, apparatuses therefor are comparatively low in cost, compact in size and excellent in quietness, and other advantages can be enjoyed.

Moreover, with the transition to high resolution image printing by inkjet printers in recent years, so-called photograph-like, high quality image recorded matter has also become available. Still moreover, with the progress in apparatus, various kinds of recording sheets for inkjet recording have also been developed.

Characteristics required of a recording sheet for use in the inkjet recording are generally listed as follows: (1) a quick drying property (high ink absorbing rate), (2) proper and uniform diameter of dots (no bleeding occurs), (3) good granularity, (4) high dot circularity, (5) high color density, (6) high chromaticity (with no dullness), (7) good lightfastness and water resistance of a printed portion, (8) high whiteness of the recording sheet, (9) good shelf stability of the recording sheet (no yellowing during long-term storage), (10) less deformability and good dimension stability (curling at a sufficiently low level), (11) being good in traveling through a machine, and the like. For application as a glossy photographic printing paper, which is used for acquiring so-called photograph-like high quality image recorded matter, requirements in addition to the above characteristics are glossiness, surface smoothness, a photographic printing paper-like touch analogous to silver halide photographs, and so on.

An inkjet recording sheet with a porous structure at a colorant-receiving layer has been developed into practical use for the purpose of improving the above characteristics. This inkjet recording sheet is excellent in ink absorptivity (quick drying property) and has high gloss because of the presence of the porous structure.

In Japanese Patent Application Laid-Open (JP-A) No. 11-115308, it is described that gas phase method (dry method) silica having a mean primary particle diameter of 10 nm or less is blended with polyvinyl alcohol (PVA) of a low saponification degree in an alkaline atmosphere with a pH value of 8 or higher and then dispersed to obtain a coating liquid, the coating liquid is applied on a substrate, and a coat film thus obtained is further coated in a still half-dry state with a coating liquid including a PVA hardener having a pH value of 8 or higher, followed by drying the composite coat film to form a colorant-receiving layer.

According to this method, however, a print image is low in density and sharpness, and cannot acquire sufficient glossiness.

In JP-A No. 10-181190, it is described that an aggregate pigment is pulverized into fine powder in a cationic resin-containing liquid to form a coating liquid containing the pigment having a particle diameter of 500 nm or less, and the coating liquid thus obtained is applied on a substrate to form a colorant-receiving layer thereon, but printed images are low in density and sharpness with insufficient glossiness.

Moreover, in JP-A No. 2000-211235, description is given of an inkjet recording sheet containing vapor-phase-process silica and a cationic polymer having as a constituent unit a polydiallyl amine derivative, but printed images are low in density and sharpness with insufficient glossiness. Still moreover, in JP-A No. 2000-211241, description is given of an inkjet recording coating liquid that uses an aqueous dispersion containing vapor-phase-process silica and has a pH value of 1.0 to 4.5, but printed images are low in density and sharpness with insufficient glossiness and, in addition to this, cracking occurs on the surface of the recording sheet.

A method has been proposed in which vapor-phase-process silica is dispersed into cationic polymer, PVA and a hardener therefor are added into the dispersion to obtain a coating liquid, and the coating liquid thus obtained is applied on a substrate, followed by low temperature drying. However, the coating liquid easily coagulates; therefore, an image thereon is also insufficient in sharpness and glossiness.

Furthermore, a chance arises that the recording sheet curls at low temperatures, thereby causing poor traveling in a printer.

As described above, the current state is such that no inkjet recording sheet has been provided that has the following characteristics: on one hand, a colorant-receiving layer is stiff without producing cracking and so on, and on the other hand, not only can a high resolution image be formed with good ink absorptivity, but a formed print image also has ink retaining performance such as excellency of water resistance and resistance to bleeding over time, together with high image density and excellence in sharpness and glossiness.

SUMMARY OF THE INVENTION

The present invention solves the prior art problems and aims to achieve the following objects.

Firstly, it is an object of the present invention to provide an inkjet recording sheet excellent in density, sharpness and glossiness of a print image, low in curling, flat and excellent in printer transportability, without reducing other aspects of ink receiving performance.

Secondly, it is an object of the present invention to provide an inkjet recording sheet that is stiff, good in ink absorptivity, and capable of forming a high resolution print image without producing cracking.

Thirdly, it is an object of the present invention to provide an inkjet recording sheet very excellent in resistance to bleeding over time after printing, water resistance and ozone fading resistance, and showing high lightfastness even under irradiation with solar rays or fluorescent lights.

The above objects are achieved by the following means:

A first aspect of the present invention provides an inkjet recording sheet comprising a support and, on a surface of the support, a colorant-receiving layer formed by: applying a first coating liquid, which has a pH value of at most 5 and is obtained by adding a solution that includes polyvinyl alcohol, a high boiling point organic solvent and at least one of a first nonionic surfactant and an amphoteric surfactant, to a dispersion that includes vapor-phase-process silica having a specific surface area of at least 200 $m^2/g$ as measured by the BET method and a cationic resin, to form a coat layer; adding, to the coat layer formed by the application of the first coating liquid, a second coating liquid, which has a pH value of at least 8.5 or higher and includes a cross-linking agent capable of cross-linking the polyvinyl alcohol, an organic mordant and a second nonionic surfactant, either at the same time as the application of the first coating liquid or during drying of the coat layer of the first coating liquid but before the coat layer shows a decreasing rate of drying; and thereafter allowing the coated layer, to which the second coating liquid has been added, to harden and dry for forming a porous structure.

A second aspect of the present invention provides an inkjet recording sheet according to the first aspect, wherein the pH value of the first coating liquid is 3.7 or lower and the pH value of the second coating liquid is 9.2 or higher.

A third aspect of the present invention provides an inkjet recording sheet according to the first aspect, wherein the vapor-phase-process silica comprises a mean primary particle diameter of 30 nm or less.

A fourth aspect of the present invention provides an inkjet recording sheet according to the first aspect, wherein the polyvinyl alcohol comprises a polyvinyl alcohol selected from the group consisting of polyvinyl alcohols, cation-modified polyvinyl alcohols, anion-modified polyvinyl alcohols, silanol-modified polyvinyl alcohols and polyvinyl alcohol derivatives.

A fifth aspect of the present invention provides an inkjet recording sheet according to the first aspect, wherein the polyvinyl alcohol comprises a weight average polymerization degree of at least 1,800 and a saponification degree of at least 90%.

A sixth aspect of the present invention provides an inkjet recording sheet according to the first aspect, wherein the polyvinyl alcohol comprises a content amount thereof in the colorant-receiving layer of from 9 to 40 mass % relative to total solid matter mass of the colorant-receiving layer.

A seventh aspect of the present invention provides an inkjet recording sheet according to the first aspect, wherein the vapor-phase-process silica in the colorant-receiving layer comprises mass i, polyvinyl alcohol in the colorant-receiving layer comprises mass p, and the content mass ratio i:p is in a range from 1.5:1 to 10:1.

An eighth aspect of the present invention provides an inkjet recording sheet according to the first aspect, wherein the cationic resin comprises a cationic resin selected from the group consisting of cationic dicyan resins, cationic polyamine resins and cationic polycation resins.

A ninth aspect of the present invention provides an inkjet recording sheet according to the first aspect, wherein the cationic resin comprises monomethyldiallylammonium chloride.

A tenth aspect of the present invention provides an inkjet recording sheet according to the first aspect, wherein the cationic resin comprises a content thereof in the colorant-receiving layer in a range from 1 to 30 mass parts relative to 100 mass parts of the vapor-phase-process silica.

An eleventh aspect of the present invention provides an inkjet recording sheet according to the first aspect, wherein the first and second nonionic surfactants comprise a surfactant selected from the group consisting of polyoxyalkylenealkyl ethers, polyoxyalkylenealkyl phenyl ethers, oxyethylene/oxypropylene block copolymers, sorbitan fatty acid esters, polyoxyethylenesorbitan fatty acid esters, polyoxyethylenesorbitol fatty acid esters, glycerine fatty acid esters, polyoxyethyleneglycerine fatty acid esters, polyoxyethylene fatty acid esters and polyoxyethylenealkyl amines.

A twelfth aspect of the present invention provides an inkjet recording sheet according to the first aspect, wherein the amphoteric surfactant comprises an amphoteric surfactant selected from the group consisting of amino acid type amphoteric surfactants, carboxyammonium betaine type amphoteric surfactants, sulfoammonium betaine type amphoteric surfactants, ammonium sulfuric ester betaine type amphoteric surfactants and imidazolium betaine type amphoteric surfactants.

A thirteenth aspect of the present invention provides an inkjet recording sheet according to the first aspect, wherein the at least one surfactant in the first coating liquid comprises a total content amount therein in a range from 0.01 mass % to 1 mass %.

A fourteenth aspect of the present invention provides an inkjet recording sheet according to the first aspect, wherein the high boiling point organic solvent is substantially water-soluble.

A fifteenth aspect of the present invention provides an inkjet recording sheet according to the first aspect, wherein the high boiling point organic solvent comprises an organic solvent selected from the group consisting of ethylene glycol, propylene glycol, diethylene glycol, triethylene glycol, glycerin, diethylene glycol monobutyl ether, triethylene glycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine, and polyethylene glycols with a weight average molecular weight of 400 or less.

A sixteenth aspect of the present invention provides an inkjet recording sheet according to the first aspect, wherein the high boiling point organic solvent comprises a content amount in the first coating liquid in a range from 0.05 mass % to 1 mass %.

A seventeenth aspect of the present invention provides an inkjet recording sheet according to the first aspect, wherein the cross-linking agent comprises a boron compound.

An eighteenth aspect of the present invention provides an inkjet recording sheet according to the first aspect, wherein the organic mordant comprises a cationic mordant.

A nineteenth aspect of the present invention provides an inkjet recording sheet according to the first aspect, further comprising at least one of thiourea and a thiocyanate.

A twentieth aspect of the present invension provides a method for producing an inkjet recording sheet, the method comprising the steps of; a) preparing a solution including polyvinyl alcohol, a high boiling point organic solvent and at least one of a first nonionic surfactant and an amphoteric surfactant; b) adding the solution to a dispersion including vapor-phase-process silica and a cationic resin for forming a first coating liquid having a pH value of at most 5, the vapor-phase-process silica including a specific surface area of at least 200 $m^2/g$ as measured by the BET method; c) preparing a second coating liquid including a cross-linking agent capable of cross-linking the polyvinyl alcohol, an organic mordant and a second nonionic surfactant, the second coating liquid having a pH value of at least 8.5; d) applying the first coating liquid to a surface of a support for forming a coat layer thereon; e) after commencement of the step of applying the first coating liquid but before the coat layer shows a decreasing rate of drying during drying thereof, adding the second coating liquid to the coat layer; and f) thereafter, allowing the coated layer to harden and dry for forming a colorant-receiving layer with a porous structure.

DESCRIPTION OF THE PREFERRED EMBODIMENTS

Inkjet Recording Sheet

An inkjet recording sheet of the present invention comprises a support and, on a surface of the support, a colorant-receiving layer formed by: applying a first coating liquid, which has a pH value of at most 5 and is obtained by adding a solution that includes polyvinyl alcohol, a high boiling point organic solvent and at least one of a first nonionic surfactant and an amphoteric surfactant, to a dispersion that includes vapor-phase-process silica having a specific surface area of at least 200 $m^2/g$ as measured by the BET method and a cationic resin, to form a coat layer; adding, to the coat layer formed by the application of the first coating liquid, a second coating liquid, which has a pH value of at least 8.5 or higher and includes a cross-linking agent capable of cross-linking the polyvinyl alcohol, an organic mordant and a second nonionic surfactant, either at the same time as the application of the first coating liquid or during drying of the coat layer of the first coating liquid but before the coat layer shows a decreasing rate of drying; and thereafter allowing the coated layer, to which the second coating liquid has been added, to harden and dry for forming a porous structure.

The inkjet recording sheet of the present invention can be improved in image density sharpness and glossiness of a print image by adjusting the pH value of the first coating liquid including the dispersion of vapor-phase-process silica, the cationic resin and the polyvinyl alcohol to be 5 or lower, and by further adding the second coating liquid with the pH value of 8.5 or higher including the cross-linking agent solution capable of cross-linking the polyvinyl alcohol. Moreover, because the vapor-phase-process silica has a specific surface area of 200 $m^2/g$ or more as measured by the BET method, the porous structure with a high void percentage can be formed.

Moreover, the inkjet recording sheet of the present invention can suppress curling of the sheet to be flat by further adding the nonionic surfactant and/or amphoteric surfactant, and the high boiling point organic solvent to the first coating liquid with the pH value of 5 or lower, prepared by adding the high saponification degree PVA to the dispersion obtained after dispersing the vapor-phase-process silica into the cationic resin. With suppression of the curling, improved appearance of a print image is realized and an improvement in printer transportability can prevent poor traveling in a printer. In addition, with the combined presence of the vapor-phase-process silica, polyvinyl alcohol, cross-linking agent and organic mordant in the colorant-receiving layer, improvements can be realized in ink absorptivity, resistance to bleeding over time, lightfastness, etc.

Colorant-receiving Layer

First, description will be given of materials included in the colorant-receiving layer. The colorant-receiving layer of the present invention includes at least the vapor-phase-process silica having a specific surface area of 200 $m^2/g$ or more as measured by the BET method, cationic resin, polyvinyl alcohol, nonionic surfactant and/or amphoteric surfactant, high boiling point organic solvent, cross-linking agent and mordant, and may further include various kinds of additives.

Vapor-phase-process Silica

As described above, the colorant-receiving layer of the present invention contains vapor phase method silica having a specific surface area of 200 $m^2/g$ or more as measured by the BET method, being inorganic pigment fine particles, (in some cases hereinafter, simply referred to as vapor-phase-process silica).

A BET method is a method for measuring a mean diameter of primary particles as described in Item 2.2 of "Nippon Aerosil K.K. technical literature No. 10" and other documents. The vapor-phase-process silica used in the present invention has a specific surface area of 200 $m^2/g$ or more, preferably 220 $m^2/g$ or more, and more preferably 300 $m^2/g$ or more as calculated on the basis of measurement with the BET method.

Silica fine particles are usually broadly classified into wet method particles and dry method particles according to production methods. In wet methods, a usual method is that active silica is produced by acidolysis of a silicate, polymerized to a proper extent and coagulation-sedimented to obtain water-containing silica. On the other hand, in gas phase methods, one usual method is that a silicon halide is hydrolyzed in a high temperature gas phase (a flame hydrolysis method) and another is that quartz sand and coke are heated with arcing in an electric furnace for reduction and vaporization, and then oxidized with air (an arc method). "Vapor-phase-process silica" means anhydrous silica fine particles obtained by one of the gas phase methods.

While the vapor-phase-process silica is different from water-containing silica with respect to surface density of silanol groups, the presence or absence of pores and other aspects, leading to a difference in its nature, the vapor-phase-process silica is suitable for formation of a three-dimensional structure with a high void percentage. The reason for this suitability is unclear, but the idea has been put forward that in a case of water-containing silica, the density of silanol groups on the surface of the fine particle is as large as 5 to 8 groups/$nm^2$ and silica fine particles are easy to aggregate in a dense state. On the other hand, in the case of gas method silica, the density of silanol groups on the surface of the fine particle is as small as 2 to 3 groups/$nm^2$; therefore the silica fine particles form loose flocculates, resulting in a high void percentage structure.

Because the vapor-phase-process silica has an especially large specific surface area, it is high in ink absorptivity and ink holding efficiency, but low in refractive index, so dispersion down to proper particle diameters may gives transparency to the receiving layer, enabling features of high color density and good color-forming property. Transparency of the receiving layer is significant from the viewpoint of acquiring high color density and good glossiness in forming color, not only in applications requiring transparency such as OHPs but also in other recording sheet applications, such as glossy photographic printing paper.

The mean primary particle diameter of the vapor-phase-process silica is preferably 30 nm or less, more preferably 20 nm or less, especially preferably 10 nm or less and most preferably in a range from 3 to 10 nm. Because particles of the vapor-phase-process silica are easy to attach to each other via hydrogen bonds between silanol groups, with a mean primary particle diameter 30 nm or less, they can form a high void-percentage structure, thereby enabling an effective improvement in ink absorptivity.

Moreover, the present invention may use, in addition to the vapor-phase-process silica, other kinds of inorganic pigment fine particles, such as water-containing silica fine particles, colloidal silica, titanium dioxide, barium sulfate, calcium silicate, zeolite, kaolinite, halloysite, mica, talc, calcium carbonate, magnesium carbonate, calcium sulfate, boehmite and pseudo boehmite. In a case where fine particles of inorganic pigment of another kind and the vapor-phase-process silica are used in combination, the content of the vapor-phase-process silica in the total of fine particles of inorganic pigments is preferably 90 mass % or more, and more preferably 95 mass % or more.

Cationic Resin

The first coating liquid can be obtained by adding the solution including polyvinyl alcohol, the nonionic surfactant and/or amphoteric surfactant, and the high boiling point organic solvent to the dispersion obtained by dispersing vapor-phase-process silica with the cationic resin.

While there is no specific limitation imposed on the cationic resin, cationic resins of a water-soluble type or an aqueous emulsion type can be preferably adopted. As the cationic resins, there can be exemplified cationic dicyan resins represented by a dicyandiamide-formalin polycondensation product, cationic polyamine resins represented by a dicyanamide-diethylenetriamine polycondensation product and cationic polycation resins such as an epichlorohydrin-dimethylamine addition polymer, a dimethyldiallylammonium chloride-$SO_2$ copolymer, a diallylamine salt-$SO_2$ copolymer, a dimethylallylammonium chloride polymer, a polymer of allylamine salt, a polymer of dialkylaminoethyl(meth)acrylilate quaternary salts, and an acrylamide-diallylamine salt copolymer. Among these, monomethyldiallylammonium chloride and polyamidine are preferable and monomethyldiallylammonium chloride is especially preferable in terms of water resistance. These cationic resins may be used alone or in a combination of two or more kinds.

As an addition quantity of the cationic resin in the colorant-receiving layer, the cationic resin is preferably used in a range from 1 to 30 mass parts relative to 100 mass parts of the vapor-phase-process silica (or relative to all inorganic pigment fine particles in a case where inorganic pigment fine particles of a kind other than vapor-phase-process silica are also used) and more preferably in a range from 3 to 20 mass parts. The cationic resin may be added in a little amount before pulverization, followed by further addition thereof after dispersion through pulverization, till a desired particle diameter is reached.

Polyvinyl Alcohol

Similarly, the colorant-receiving layer of the present invention contains polyvinyl alcohol, which is a water-soluble resin.

As the polyvinyl alcohol, there can be exemplified, in addition to polyvinyl alcohol (PVA), a cation-modified polyvinyl alcohol, an anion-modified polyvinyl alcohol, a silanol-modified polyvinyl alcohol, and other derivatives of polyvinyl alcohol. These polyvinyl alcohols may be used alone or in a combination of two or more kinds.

While the above PVA has a hydroxyl group in its constituent unit, a hydroxyl group and a surface silanol group on the silica fine particle form a hydrogen bond, which makes it easy to form a three-dimensional network structure with secondary particles of the silica fine particles as a chain unit. It is thought that formation of the three-dimensional network structure can form a colorant-receiving layer with a high void-percentage porous structure.

In inkjet recording, the porous colorant-receiving layer thus obtained can absorb ink rapidly by capillarity to form dots good in circularity without any ink bleeding.

The content of the polyvinyl alcohol is preferably in a range from 9 to 40 mass % and more preferably in a range from 16 to 33 mass % of the total solid matter mass of the colorant-receiving layer, in order to prevent a reduction in film strength and cracking in a dried condition with an excessively low content, and in order to prevent easy plugging of voids in the layer by resin and a consequent reduction in ink absorptivity caused by the decrease in void percentage with an excessively high content. A number-average polymerization degree of the polyvinyl alcohol described above is preferably 1,800 or more and more preferably 2,000 or more from the viewpoint of prevention of cracking. The saponification degree of the PVA is more preferably 90% or more and especially preferably 95% or more from the viewpoints of transparency and viscosity of the colorant-receiving layer coating liquid.

Moreover, in the present invention, other water-soluble resins may be used together with the PVA, as which are exemplified: polyvinyl acetal; cellulosic resins such as methyl cellulose (MC), ethyl cellulose (EC), hydroxyethyl cellulose (HEC), carboxymethyl cellulose (CMC) and the like; chitins; chitosans; starch; resins having an ether bond such as polyethylene oxide (PEO), polypropylene oxide (PPO), polyethylene glycol (PEG) and polyvinyl ether (PVE); resins having an amide group or an amide bond such as polyacrylic amide (PAAM) and polyvinyl pyrrolidone (PVP); and resins having a carboxyl group as a dissociative group such as polyacrylic acid salts, maleic acid resins, alginates and gelatins. In a case where the polyvinyl alcohol and other water-soluble resins are used, the content of the polyvinyl alcohol in the entire water-soluble resins is preferably 90 mass % or more and more preferably 95 mass % or more.

Ratio of Vapor-phase-process Silica to Polyvinyl Alcohol

A ratio (PB=i:p) of the content of the vapor-phase-process silica i (the total of inorganic pigment fine particles in a case where fine particles of inorganic pigment of another kind are used together with the vapor-phase-process silica) to the polyvinyl alcohol p (the total water-soluble resins in a case where a water-soluble resin of another kind is used together with the polyvinyl alcohol), that is, a mass of the vapor-phase-process silica relative to 1 mass part of polyvinyl alcohol, exerts great influence on the film structure of the colorant-receiving layer. That is, with an increase in the PB ratio, void percentage, pore volume, and surface area (per unit mass) are larger.

Specifically, the PB ratio (i:p) is preferably in the range of 1.5:1 to 10:1 in order to prevent a reduction in film strength and cracking in a dried condition due to an excessively high PB ratio and to prevent easy plugging of voids in the layer by resin and a reduction in ink absorptivity due to a consequent decrease in void percentage, due to an excessively low PB ratio.

When the recording sheet travels through a transportation system of an inkjet printer, stress may be exerted on the recording sheet; so a necessity arises for a sufficient film strength of the colorant-receiving layer. Moreover, when a recording sheet raw material is cut into sheet pieces, the colorant-receiving layer of the raw material again has to have sufficient film strength to prevent cracking of the colorant-receiving layer, separation thereof and other problems.

In this case, the PB ratio is preferably 5:1 or lower and preferably 2:1 or more in order to ensure high ink absorptivity.

For example, in a case where a coating liquid obtained by dispersing anhydrous silica fine particles of a mean primary particle diameter of 20 nm or less and the water-soluble resin completely into an aqueous solution for a PB ratio of 2:1 to 5:1 is applied on a support, followed by drying the coat layer, a three-dimensional network structure with secondary silica fine particles as chain units is formed and a porous film transparent to light with the following characteristics can be easily formed: an average pore diameter of 30 nm or less, a void percentage in a range from 50% to 80%, a specific pore volume of 0.5 ml/g or more and a specific surface area of 100 $m^2/g$ or more.

Surfactant)

The first coating liquid includes a nonionic surfactant and/or an amphoteric surfactant, and the second coating liquid includes a nonionic surfactant. As the nonionic surfactants, there can be preferably exemplified: polyoxyalkylenealkyl ethers and polyoxyalkylenealkyl phenyl ethers such as diethyleneglycol monoethyl ether, diethyleneglycol diethyl ether, polyoxyethylenelauryl ether, polyoxyethylenestearyl ether, polyoxyethylenenonyl phenyl ether and the like; oxyethylene-oxypropylene block polymers and sorbitan fatty acid esters such as sorbitan monolaurate, sorbitan monoolate, sorbitan triolate and the like; polyoxyethylenesorbitan fatty acid esters such as polyoxyethylenesorbitan monolaurate, polyoxyethylenesorbitan monoolate, polyoxyethylenesorbitan triolate and the like; polyoxyethylenesorbitol fatty acid esters such as tetraoleic acid polyoxyethylenesorbit and the like; glycerin fatty acid esters such as glycerol monoolate and the like; polyoxyethyleneglycerin fatty acid esters such as polyoxyethyleneglycerin monostearate, polyoxyethyleneglycerin monoolate and the like; polyoxyethylene fatty acid esters such as polyethyleneglycol monolaurate, polyethyleneglycol monoolate and the like; polyoxyethylenealkyl amines; and the like. Among these, polyoxyalkylenealkyl ethers are preferable. The nonionic surfactant described above can be used both in the first coating liquid and the second coating liquid. Nonionic surfactants described above may be used alone or in a combination of two or more kinds. In a case where nonionic surfactants are used in both the first coating liquid and the second coating liquid, the nonionic surfactants may be the same as each other or different from each other.

As the amphoteric surfactant, there can be exemplified amino acid types, carboxyammonium betaine types, ammonium sulfuric ester betaine types and imidazolium betaine types; for example, amphoteric surfactants described in the following patent and patent applications can be preferably used: U.S. Pat. No. 3,843,368; and JP-A Nos. 59-49535, 63-236546, 5-303205, 8-262742, 10-282619 and the like. As the amphoteric surfactant, an amino acid type amphoteric surfactant is preferable, and as the amino acid type amphoteric surfactants, which can be obtained as derivatives from, for example, amino acids (glycine, glutaminic acid, histidine acid, etc.) as described in JP-A No. 5-303205, there can be exemplified N-aminoacyl acid into which a long chain acyl group is introduced and salts thereof. The amphoteric surfactant may be used alone or in a combination of two or more kinds and, moreover, may be used together with the nonionic surfactant described above.

The content of the nonionic surfactant and/or an amphoteric surfactant in the first coating liquid is preferably in a range from 0.01 to 1 mass % and especially preferably in a range from 0.03 to 0.6 mass %. The content of the nonionic surfactant in the second coating liquid is preferably in a range from 0.001 to 0.5 mass % and especially preferably in a range from 0.05 to 0.3 mass %.

High Boiling Point Organic Solvent

Curling of the inkjet recording sheet can be suppressed and flatness preserved by adding the nonionic surfactant and/or amphoteric surfactant, as described above, and the high boiling point organic solvent to the first coating liquid.

As the high boiling point organic solvent, a water-soluble type is preferable and as water-soluble high boiling point organic solvents, there are exemplified: alcohols such as ethylene glycol, propyleneglycol, diethyleneglycol, triethyleneglycol, glycerin, diethyleneglycol monobutyl ether (DEGMBE), triethyleneglycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine, polyethyleneglycol (weight average molecular weight is 400 or less). Among these, diethyleneglycol monobutyl ether (DEGMBE) is preferable.

The content of the high boiling point organic solvent in the first coating liquid is preferably in a range from 0.05 to 1 mass % and especially preferably in a range from 0.1 to 0.6 mass %.

Cross-linking Agent

The colorant-receiving layer of the inkjet recording sheet of the present invention is a layer obtained by adding the cross-linking agent capable of cross-linking polyvinyl alcohol to the coat layer (the porous layer) including inorganic pigment fine particles (the vapor-phase-process silica) and water-soluble resin (the polyvinyl alcohol), to harden the coat layer through a cross-linking reaction between the cross-linking agent and the polyvinyl alcohol.

Addition of the cross-linking agent is preferably performed by adding the second coating liquid, including the cross-linking agent, to the coat layer formed by the application of the first coating liquid (the colorant-receiving layer coating liquid) either at the same time as the application of the first coating liquid or before the coat layer of the first coating liquid shows a decreasing rate of drying during drying thereof. By such an operation, occurrence of cracking during the drying of the coat layer can be effectively prevented. That is, the second coating liquid (the cross-linking agent solution) penetrates through the coat layer at the same time as application of the first coating liquid or before the coat layer shows a decreasing rate of drying during drying thereof, and reacts swiftly with the polyvinyl alcohol in the coat layer to gelate (harden) the polyvinyl alcohol and thereby greatly improve film strength of the coat layer.

The cross-linking agent capable of cross-linking the polyvinyl alcohol described above needs only be selected to be suitable in regard to a relationship with the water-soluble resin used in the colorant-receiving layer. Boron compounds are preferable among available cross-linking agents because of a swift cross-linking reaction. As the boron compound, there can be exemplified: borax, boric acid, borates (for example, orthoborate, $InBO_3$, $ScBO_3$, $YBO_3$, $LaBO_3$, $Mg_3(BO_3)_2$, $Co_3(BO_3)_2$); diborates (for example, $Mg_2B_2O_5$, and $Co_2B_2O_5$); metaborates (for example, $LiBO_2$, $Ca(BO_2)_2$, $NaBO_2$ and $KBO_2$); tetraborates (for example, $Na_2B_4O_7.10H_2O$) and pentaborates (for example, $KB_5O_8.4H_2O$, $Ca_2B_6O_{11}.7H_2O$ and $CsB_5O_5$) and the like.

Among these, borax, boric acid and borate are preferable, and a borate is especially preferable because of a swift cross-linking reaction with the polyvinyl alcohol.

In a case where gelatin is used together with the polyvinyl alcohol described above, the following compounds, which have been known as film hardeners for gelatin, can be used as the cross-linking agent.

The following are exemplified: aldehydes such as formaldehyde, glyoxal, glutaraldehyde; ketones such as diacetyl and cyclopentanedion; active halogen compounds such as bis(2-chloroethyl urea)-2-hydroxy-4,6-dichloro-1,3,5-triazine, 2,4-dichloro-6-S-triazine sodium salt and the like; active vinyl compounds such as divinylsulfonic acid, 1,3-vinylsulfonyl-2-propanol, N,N'-ethylene bis(vinylsulonylacetamide), 1,3,5-triacryloyl-hexahydro-S-triazine and the like; and N-methylol compounds such as dimethylol urea, methylol dimethyl hydantoin and the like; isocyanates such as 1,6-hexamethylenediisocyanate and the like; aziridines described in U.S. Pat. Nos. 3,017,280 and 2,983,611; carboxyimides described in U.S. Pat. No. 3,100,704; epoxy compounds such as glycerol triglycidyl ether; ethyleneimino compounds such as 1,6-hexamethylene-N,N'-bisethylene urea and the like; halogenated carboxyaldehydes such as mucochloric acid and mucophenoxychloric acid; dioxanes such as 2,3-dihydroxy dioxane and the like; and chrome alum, potassium alum, zirconium sulfate, chromium acetate, and the like.

Note that the cross-linking agents may be used alone or in a combination of two or more kinds.

When the cross-linking agent described above is added, the second coating liquid including the cross-linking agent is prepared as a solution of the cross-linking agent in water and/or an organic solvent.

The concentration of the cross-linking agent in the second coating liquid is preferably in a range from 0.05 to 10 mass % and especially preferably in a range from 0.1 to 7 mass %.

The solvent constituting the second coating liquid is generally water, and may be a water-based mixed solvent including an organic solvent compatible with water.

As the organic solvent, any solvent can be used as long as the cross-linking agent is soluble therein, and there can be exemplified: alcohols such as methanol, ethanol, isopropyl alcohol, glycerin and the like; ketones such as acetone, methyl ethyl ketone and the like; esters such as methyl acetate, ethyl acetate and the like; aromatic solvents such as toluene and the like; ethers such as tetrahydrofuran and the like; and halogenated hydrocarbon solvent such as dichloromethane and the like.

Organic Mordant

In the present invention, an organic mordant (hereinafter simply referred to as mordant) is included in the colorant-receiving layer in order to further improve water resistance and resistance to bleeding over time.

As the mordant, a cationic polymer (cationic mordant) is preferable, and when the mordant is present in the colorant-receiving layer, it interacts with liquid ink including an anionic dye as a colorant to stabilize the colorant, thereby enabling an improvement of water resistance and resistance to bleeding over time.

However, when the mordant is added directly to the first coating liquid for forming the colorant-receiving layer, there is a risk of coagulation with the gas phase silica having an anionic charge. Therefore, by preparing the mordant for application in an independent, separate solution, the risk of coagulation of the inorganic pigment fine particles disappears. Accordingly, in the present invention, the mordant, when being applied, is included in the second coating liquid, separate from the vapor-phase-process silica.

As the cationic mordant, polymer mordants having primary to tertiary amino groups or quaternary ammonium groups as cationic groups are suitably used, but a cationic non-polymer mordant may be used.

As the polymer mordants, there are preferably exemplified: homopolymers of a monomer (a mordant monomer) having primary to tertiary amino groups and salts thereof or a quaternary ammonium base, copolymers or condensation polymers of a mordant monomer and a monomer which is not a mordant (hereinafter referred to as a non-mordant monomer). Moreover, the polymer mordants can be used in the form of a water-soluble polymer or of latex particles with water dispersibility.

As the monomers (mordant monomers), there can be exemplified: trimethyl-p-vinylbenzylammonium chloride, trimethyl-m-vinylbenzylammonium chloride, triethyl-p-vinylbenzylammonium chloride, triethyl-m-vinylbenzylammonium chloride, N,N-dimethyl-N-ethyl-N-p-vinylbenzylammonium chloride, N,N-diethyl-N-methyl-N-p-vinylbenzylammonium chloride, N,N-dimethyl-N-n-propyl-N-p-vinylbenzylammonium chloride, N,N-dimethyl-N-n-octyl-N-p-vinylbenzylammonium chloride, N,N-dimethyl-N-benzyl-N-p-vinylbenzylammonium chloride, N,N-diethyl-N-benzyl-N-p-vinylbenzyl ammonium chloride, N,N-dimethyl-N-(4-methyl)benzyl-N-p-vinylbenzylammonium chloride, N,N-dimethyl-N-phenyl-N-p-vinylbenzylammonium chloride; trimethyl-p-vinylbenzylammonium bromide, trimethyl-m-vinylbenzylammonium bromide; trimethyl-p-vinylbenzylammonium sulfonate, trimethyl-m-vinylbenzylammonium sulfonate; trimethyl-p-vinylbenzylammonium acetate, trimethyl-m-vinylbenzyl ammonium acetate; N,N,N-triethyl-N-2-(4-vinylphenyl) ethylammonium chloride, N,N,N-triethyl-N-2-(3-vinylphenyl)ethylammonium chloride; N,N-diethyl-N-methyl-N-2-(4-vinylphenyl)ethylammonium chloride; N,N-diethyl-N-methyl-N-2-(4-vinylphenyl) ethylammonium acetate; N,N-dimethylaminoethyl (meth)acrylate, N,N-diethyl aminoethyl (meth)acrylate, N,N-dimethylaminopropyl (meth)acrylate, N,N-diethyl aminopropyl (meth) acrylate; N,N-dimethylaminoethyl (meth) acrylamide, N,N-diethylaminoethyl (meth)acrylamide, N,N-dimethylaminopropyl (meth)acrylamide; and quaternarized compounds of N,N-dimethylaminopropyl (meth)acrylamide obtained with methyl chloride, ethyl chloride, methyl bromide, ethyl bromide, methyl iodide or ethyl iodide, or alternately, sulfonates, alkylsulfonates, acetates or alkylcarboxylates obtained by replacement of an anion of the quaternarized compounds.

To be concrete, there can be exemplified: monomethyl-diallylammonium chloride, trimethyl-2-(methacryloyloxy) ethylammonium chloride, triethyl-2-(methacryloyloxy) ethylammonium chloride, trimethyl-2-(acryloyloxy) ethylammonium chloride, triethyl-2-(acryloyloxy) ethylammonium chloride, trimethyl-3-(methacryloyloxy) propyl ammonium chloride, triethyl-3-(methacryloyloxy) propylammonium chloride; trimethyl-2-(methacryloylamino)ethylammonium chloride, triethyl-2-(methacryloylamino) ethylammonium chloride; trimethyl-2-(acryloylamino)ethylammonium chloride, triethyl-2-(acryloylamino)ethylammonium chloride; trimethyl-3-(methacryloylamino) propylammonium chloride, triethyl-3-(methacryloylamino)propylammonium chloride; trimethyl-3-(acryloylamino)propylammonium chloride, triethyl-3-(acryloylamino) propylammonium chloride; N,N-dimethyl-N-ethyl-2-(methacryloyloxy)ethylammonium chloride, N,N-diethyl-N-methyl-2-(methacryloyloxy) ethylammonium chloride; N,N-dimethyl-N-ethyl-3-(acryloylamino)propylammonium chloride; trimethyl-2-(methacryloyloxy)ethylammonium bromide; trimethyl-3-(acryloylamino)propyl ammonium bromide; trimethyl-2-(methacryloyloxy)ethylammonium sulfonate; trimethyl-3-(acryloylamino)propylammonium acetate; and the like.

In addition to the above compounds, as co-polymerizable monomers, there can also be exemplified N-vinylimidazole, N-vinyl-2-methylimidazole and the like.

The non-mordant monomer is a monomer not including a basic or cationic moiety such as a primary to tertiary amino group, a salt thereof or a quaternary ammonium base, and shows no or substantially no interaction with a dye in an inkjet ink.

As the non-mordant monomer, there can be exemplified: (meth)acrylic acid cycloalkyl esters such as (meth)acrylic acid alkyl ester, cyclohexyl (meth)acrylate and the like; (meth)acrylic acid aryl ester such as phenyl (meth)acrylate and the like; aralkyl esters such as benzyl (meth)acrylate and the like; aromatic vinyls such as styrene, vinyltoluene, α-methylstyrene and the like; vinyl esters such as vinyl acetate, vinyl propionate, vinyl barsatate and the like; allyl esters such as allyl acetate and the like; halogen containing monomers such as vinylidene chloride, vinyl chloride and the like; vinyl cyanides such as (meth)acrylonitril and the like; olefins such as ethylene, propylene and the like; and the like.

Of the (meth)acrylic acid alkyl esters, preferable are (meth)acrylic acid alkyl esters, an alkyl moiety of which has 1 to 18 carbons and there are exemplified: methyl (meth) acrylate, ethyl (meth)acrylate, propyl (meth)acrylate, isopropyl (meth)acrylate, n-butyl (meth)acrylate, isobutyl (meth)acrylate, t-butyl (meth)acrylate, hexyl (meth)acrylate, octyl (meth)acrylate, 2-ethyl hexyl (meth)acrylate, lauryl (meth)acrylate, stearyl (meth)acrylate and the like. Preferable among these are methyl acrylate, ethyl acrylate, methyl methacrylate, ethyl methacrylate and hydroxyethyl methacrylate.

The non-mordant polymers can be used alone or in a combination of two or more kinds. In addition, as polymer mordants, there are also preferably exemplified: polydiallyldimethylammonium chloride, polymethacryloyloxyethy-β-hydroxyethyl dimethylammonium chloride, polyethyleneimine, polyallylamine and modified compounds thereof, polyallylamine hydrochloric acid salt, polyamide-polyamine resin, cationic starch, dicyandiamide-formalin condensate, dimethy-2-hydroxypropylammonium salt polymer, polyamidine, polyvinylamine and the like, and among these, modified polyallylamine is especially preferable.

The modified polyallylamines are polyallylamines having added thereto acrylonitrile, chloromethylstyrene, TEMPO, epoxyhexane, sorbic acid or the like at 2 to 50 mol % relative to the total quantity of polyallylamine, and preferably having added thereto acrylonitrile or chloromethylstyrene at 5 to 10 mol %, and especially preferably acrylonitrile at 5 to 10 mol %, because of an effect of prevention of ozone fading.

The molecular weight of the mordant is preferably in a range from 5,000 to 30,000 in terms of weight-average molecular weight. If the molecular weight is in a range from 5000 to 30,000, improvements can be realized in water resistance and resistance to bleeding over time.

Ozone Fading Preventive Agent

The inkjet recording sheet of the present invention can prevent ozone fading from occurring by containing thiourea, thiocyanate or the like in the colorant-receiving layer.

As the thiocyanate, there are exemplified: ammonium thiocyanate, zinc thiocyanate, calcium thiocyanate, potassium thiocyanate, sodium thiocyanate, magnesium thiocyanate, aluminum thiocyanate, lithium thiocyanate, silver thiocyanate, chloromethyl thiocyanate, cobalt thiocyanate, copper thiocyanate, lead thiocyanate, barium thiocyanate, benzyl thiocyanate and the like. The thiourea and thiocyanates may be used alone or in a combination of two or more kinds.

Although in the present invention the thiourea or thiocyanate described above may be added to either the first coating liquid or the second coating liquid, it is preferable from the viewpoint of liquid stability to add the thiourea or thiocyanate to the colorant-receiving layer by inclusion in the second coating liquid. The content of the thiourea or thiocyanate in the colorant-receiving layer is preferably in a range from 1 to 20 mass % and especially preferably in a range from 2 to 10 mass %. If the content is less than 1 mass %, it will be difficult to exert a sufficient ozone fading preventive effect, and if greater than 20 mass %, there may be cases where cracking occurs.

Other Components

The colorant-receiving layer may include the following components according to necessity.

For the purpose of suppressing degradation of a colorant, the following fading-preventive agents may be contained: ultraviolet-absorbents, antioxidants, singlet oxygen quenchers, and the like. As the ultraviolet absorbents, there are exemplified: cinnamic acid derivatives, benzophenone derivatives, benzotriazolylphenol derivatives, and the like. To be specific, there are further exemplified: butyl α-cyanophenylcinnamate, o-benzotriazolephenol, o-benzotriazole-p-chlorophenol, o-benzotriazole-2,4-di-t-butylphenol, o-benzotriazole-2,4-di-t-octylphenol and the like. Hindered phenol compounds can be used as the ultraviolet absorbent. Specifically, preferable are phenol derivatives having a branched alkyl group as a substituent at at least one of the second and sixth positions of a benzene nucleus.

Moreover, the following ultraviolet absorbents can be used: benzotriazole ultraviolet absorbents, salicylic acid ultraviolet absorbents, cyanoacrylate ultraviolet absorbents, oxalic acid anilide ultraviolet absorbents and the like, for example, the ultraviolet absorbing agents described in the following patents and patent applications: JP-A Nos. 47-10537, 58-111942, 58-212844, 59-19945, 59-46646, 59-109055, and 63-53544; Japanese Patent Application Publication (JP-B) Nos. 36-10466, 42-26187, 48-30492, 48-31255, 48-41572, 48-54965 and 50-10726; U.S. Pat. Nos. 2,719,086; 3,707,375; 3,754,919; and 4,220,711; and the like.

Fluorescent whitening agents can be used as the ultraviolet absorbent, and coumarin fluorescent whitening agents and the like can be exemplified. Fluorescent whitening agents are detailed in JP-B Nos. 45-4699, 54-5324, and the like.

As the antioxidant, there can be exemplified those disclosed in patents and patent applications as follows: EP Nos. 223739, 309401, 309402, 310551, 31052 and 459416; DP No. 3435443; JP-A Nos. 54-48535, 60-107384, 60-107383, 60-125470, 60-125471, 60-125472, 60-287485, 60-287486, 60-287487, 60-287488, 61-160287, 61-185483, 61-211079, 62-146678, 62-146680, 62-146679, 62-282885, 62-262047, 63-051174, 63-89877, 63-88380, 63-113536, 63-163351, 63-203372, 63-224989, 63-251282, 63-267594, 63-182484, 1-239282, 2-262654, 2-71262, 3-121449, 4-291685, 4-291684, 5-61166, 5-119449, 5-188687, 5-188686, 5-110490, 5-1108437, and 5-170361; JP-B Nos. 48-43295 and 48-33212; and U.S. Pat. Nos. 4,814,262; and 4,980,275; and the like.

To be specific, there can be exemplified: 6-ethoxy-1-phenyl-2,2,4-trimethyl-1,2-dihydroquinoline, 6-ethoxy-1-octyl-2,2,4-trimethyl-1,2-dihydroquinoline, 6-ethoxy-1-phenyl-2,2,4-trimethyl-1,2,3,4-tetrahydroquinoline, 6-ethoxy-1-octyl-2,2,4-trimethyl-1,2,3,4-tetrahydroquinoline, nickel cyclohexanoate, 2,2-bis(4-hydroxyphenyl)propane, 1,1-bis(4-hydroxyphenyl)-2-ethylhexane, 2-methyl-4-methoxy-diphenylamine, 1-methyl-2-phenylindole and the like.

Fading preventive agents may be used alone or in a combination of two or more kinds. The fading preventive agents may also be used in solution, in dispersion or in emulsion, or can be contained in micro-capsules.

An addition quantity of the fading preventive agent described above is preferably in the range of 0.01 to 10 mass % of the colorant-receiving layer coating liquid.

The colorant-receiving layer coating liquid may include inorganic salts for the purpose of enhancing dispersibility of the inorganic pigment fine particles, and acids, alkalis and the like as pH adjusting agents.

The colorant-receiving layer coating liquid may include metal oxide fine particles having electronic conductivity for the purpose of suppressing frictional charges and peeling charges on the surface of the support, and further may include mat agents for the purpose of reducing a surface frictional characteristic.

Formation Method

Next, description will be given of a method for forming the colorant-receiving layer. The colorant-receiving layer of the present invention has a porous structure, and is formed by applying to a surface of a support a first coating liquid, which has a pH value of at most 5 and is obtained by adding a solution that includes polyvinyl alcohol, a high boiling point organic solvent and at least one of a first nonionic surfactant and an amphoteric surfactant, to a dispersion that includes vapor-phase-process silica having a specific surface area of at least 200 $m^2/g$ as measured by the BET method and a cationic resin, to form a coat layer; adding, to the coat layer formed by the application of the first coating liquid, a second coating liquid, which has a pH value of at least 8.5 or higher and includes a cross-linking agent capable of cross-linking the polyvinyl alcohol, an organic mordant and a second nonionic surfactant, either at the same time as the application of the first coating liquid or during drying of the coat layer of the first coating liquid but before the coat layer shows a decreasing rate of drying; and thereafter allowing the coated layer, to which the second coating liquid has been added, to harden and dry.

As described above, in the present invention, the water resistance of the colorant-receiving layer can be improved by simultaneous coating of the cross-linking agent and the mordant. That is, if the mordant is added to the coating liquid for the colorant-receiving layer, coagulation may occur due to the co-existence of the vapor-phase-process silica having a surface anionic charge, because the mordant is of a cationic nature, but by preparing the second coating liquid, including the mordant, and the colorant-receiving layer coating liquid independently of each other and applying the two liquids separately, no necessity arises for giving consideration to coagulation of the inorganic pigment fine particles, ensuring a wider range for selection of mordants.

In the present invention, there is prepared the first coating liquid (colorant-receiving layer coating liquid) including the vapor-phase-process silica, cationic resin, PVA, the nonionic surfactant and/or amphoteric surfactant, and the high boiling point organic solvent, for example, as follows:

The vapor-phase-process silica is added into water, the cationic resin is further added to the water, and a mixture thus obtained is transformed into the dispersion using a high pressure homogenizer or a sand mill. Thereafter, a polyvinyl alcohol aqueous solution (for example, with the PVA amount at around ⅓ as much as the vapor-phase-process silica in terms of mass) is added to the dispersion, followed by addition of the at least one of a nonionic surfactant and an amphoteric surfactant, and the high boiling point organic solvent. Then the resultant mixture is stirred, thus preparing the first coating liquid. The thus obtained coating liquid is a uniform sol, and is applied on the support by a coating method described below, thereby enabling formation of a colorant-receiving layer of a porous nature and having a three-dimensional network structure.

The first coating liquid of the present invention must have a pH of about 5 or lower, preferably 4.2 or lower and further preferably 3.7 or lower. If the pH of the first coating liquid is higher than 5, a reduction will occur in print density, sharpness and glossiness of print images. The pH value of the first coating liquid can be adjusted to 5 or lower by properly selecting the kind and addition quantity of the cationic resin. The pH may be adjusted by adding an inorganic acid or alkali.

The first coating liquid (colorant-receiving layer coating liquid) can also further have added thereto a pH adjusting agent, an anti-static agent and the like as necessary.

Application of the first coating liquid (colorant-receiving layer coating liquid) can be performed with known methods such as an extrusion die coater, an air doctor coater, a blade coater a rod coater, a knife coater, a squeeze coater, a reverse roll coater, a bar coater and the like.

After application of the first coating liquid has ended, the second coating liquid is added on the coat layer of the first coating liquid. The second coating liquid may be added at a stage subsequent to the application of the first coating liquid, before the coat layer shows a decreasing rate of drying. That is, the colorant-receiving layer is suitably fabricated by introducing the cross-linking agent, mordant and nonionic surfactant into the coat of the first coating agent during a period subsequent to application of the first coating liquid while the coat layer is exhibiting a constant drying rate.

The second coating liquid must have a pH of about 8.5 or higher, preferably 9.0 or higher and more preferably 9.2 or higher. If the pH of the second coating liquid is lower than 8.5, cracking will occur in the colorant-receiving layer.

The term "before the coat layer shows a decreasing rate of drying" means a period of several minutes directly after application of the colorant-receiving layer coating liquid ends. During this period, there is shown a constant drying rate, that is, content of a solvent in the coat layer decreases in proportion to elapsed time. Periods when a constant drying rate is exhibited are discussed in *Chemical Engineering Handbook* (pp. 707 to 712, published by Maruzen Co., Ltd. on Oct. 25, 1980).

As described above, after the first coating liquid (a colorant-receiving layer coating liquid) has been applied, the coat layer is dried till the coat layer comes to show a decreasing rate of drying. The drying is generally performed in conditions of a temperature in a range from 50 to 180° C. and a period in a range from 0.5 to 10 min (preferably 0.5 to 5 min). Of course, the drying period is properly adjusted according to coating weight.

As methods to add the second coating liquid to the coat layer before the coat layer comes to show a decreasing rate of drying, there are exemplified: (1) a method in which the cross-linking liquid is further applied on the coat layer, (2) a method in which the second coating liquid is atomized and sprayed with a spray or the like, (3) a method in which the support on which the coat layer has been formed is immersed into the second coating liquid (a cross-linking agent solution), and the like.

In the method (1), as an application method for the second coating liquid (cross-linking agent solution), the following application methods can be exemplified for use: known methods such as a curtain flow coater, an extrusion die coater, an air doctor coater, a blade coater, a rod coater, a knife coater, a squeeze coater, a reverse roll coater, a bar coater and the like. However, it is preferable to use methods in which a coater is not in direct contact with the already-formed coat layer, such as an extrusion die coater, a curtain flow coater, bar coater or the like.

The coating weight of the second coating liquid (cross-linking agent solution) added to the colorant-receiving layer is generally in the range of 0.01 to 10 g/m$^2$ and preferably in a range from 0.05 to 5 g/m$^2$ in terms of weight of the cross-linking agent.

After application of the cross-linking solution, the coat layer is generally heated at a temperature in a range from 40 to 180° C. for a period in a range from 0.5 to 30 min for drying and hardening. With regard to these conditions, the temperature is preferably in a range from 40 to 150° C. and the time period is preferably in a range from 1 to 20 min.

For example, in a case where borax or boric acid is used as the boron compound included in the cross-linking agent, it is preferable to heat at a temperature in the range of 60 to 100° C. for a time period in the range of 0.5 to 15 min.

Further, the second coating liquid (cross-linking agent solution) described above may be added at the same time as the first coating liquid (the colorant-receiving layer coating liquid) is applied.

In this case, the colorant-receiving layer coating liquid and the cross-linking agent solution are applied on the support at the same time (laminar coating) with the colorant layer coating liquid being applied in direct contact with the support, followed by drying and hardening, thereby enabling formation of the colorant-receiving layer.

This simultaneous coating (laminar coating) can be implemented with application methods using an extrusion die coater or a curtain flow coater. After the simultaneous coating, the formed coat layer is dried. The drying in this case is generally carried out at a temperature in the range of 40 to 150° C. for a time period in the range of 0.5 to 10 min and preferably at a temperature in the range of 40 to 100° C. for a time period in the range of 0.5 to 5 min.

For example, in a case where borax or boric acid is used as the cross-linking agent included in the cross-linking agent solution, it is preferable to heat at a temperature in the range of 60 to 100° C. for a time period in the range of 5 to 20 min.

In a case where the simultaneous coating (laminar coating) is carried out with, for example, an extrusion die coater, the two kinds of coating liquids discharged simultaneously are shaped into a double-layer structure in the vicinity of the discharge port of the extrusion die coater before being transferred onto the support. That is, the laminar structure is structured and then applied onto the support. The laminated coating liquids of the laminar structure which has been established prior to application are already in a state to cause the cross-linking reaction at an interface between the two liquids with ease when transferred onto the. Therefore, the two liquids discharged from the extrusion die coater mix into each other, which tends to increase viscosity in the mixture, resulting in problems with application operations in some case. Accordingly, in the case of simultaneous coating, a triple layer coating is preferable, in which a barrier layer liquid (an intermediate layer liquid) constituted of a material that does not react with the cross-linking agent is interposed between the two liquids when the two liquids are applied, i.e., between the colorant-receiving layer coating liquid and the cross-linking agent solution including, the cross-linking agent and the mordant.

The barrier layer liquid has no specific limitation on selection as long as it can form a liquid film without reacting with the boron compound. For example, there can be mentioned an aqueous solution or water including a small quantity of a water-soluble resin that will not react with the boron compound. The water-soluble resin, taking coating performance into consideration, is used as a thickener or the like and there are exemplified: polymers such as hydroxypropylmethyl cellulose, methyl cellulose, hydroxyethylmethyl cellulose, polyvinyl pyrrolidone, gelatin and the like.

Note that the mordant described above can also be added as a constituent in the barrier layer liquid.

Solvents used in each process step can be water, an organic solvent or a mixed solvent thereof. As organic solvents that can be used in coating, there are exemplified: alcohols such as methanol, ethanol, n-propanol, i-propanol and methoxypropanol; ketones such as acetone and methyl ethyl ketone; tetrahydrofuran, acetonitrile, ethyl acetate, toluene and the like.

After the colorant-receiving layer is formed on the support, the colorant-receiving layer is calendered by being passed through nip rollers under heating and pressure using a supercalender, a gloss calender or the like, to thereby enable improvements in surface smoothness, glossiness, transparency and coating film strength. Because the calendering acts to reduce the void percentage (that is, ink absorptivity) however, a requirement arises that conditions be set for a smaller reduction in the void percentage.

A rolling temperature in the case of calendering is preferably in a range from 30 to 150° C. and more preferably in a range from 40 to 100° C.

A linear pressure between rolls in calendering is preferably in a range from 50 to 400 kg/cm and more preferably in a range from 100 to 200 kg/cm.

The thickness of the colorant-receiving layer, in the case of inkjet recording, must be determined in connection with the void percentage in the layer because of the necessity for an absorption capacity that will absorb all of a liquid droplet. For example, in a case where an ink quantity is 8 nl/mm$^2$ and the void percentage is 60%, the thickness is required to be about 15 $\mu$m or more.

Considering this aspect, in the case of inkjet recording, the thickness of the colorant-receiving layer is preferably in a range from 10 to 50 $\mu$m.

Pore diameters in the colorant-receiving layer are preferably in a range from 0.005 to 0.030 $\mu$m and more preferably in a range from 0.01 to 0.025 $\mu$m in median diameter.

The void percentage and pore median diameter described above can be measured with a mercury porosimeter (made by Shimadzu Corporation under the trade name Poresizer 9320-PC2).

The colorant-receiving layer is preferably excellent in transparency, and as a guide index therefor, a haze value of the colorant-receiving layer formed on a transparent film support is preferably 30% or less and more preferably 20% or less.

The haze value can be measured with a haze meter (made by Suga Test Instrument Co., Ltd. under the trade name HGM-2DP).

Support

As the support described above, there can be used either a transparent support made of a transparent material such as plastic or the like or a non-transparent support made of a non-transparent material such as paper or the like. In order to make best use of the transparency feature of the colorant-receiving layer, it is preferable to use a transparent support or a highly glossy non-transparent support.

As materials that can be used for the transparent support, materials that are transparent and capable of resisting radiation heat received when used with an OHP or a back-light display are preferable. As actual materials, there can be exemplified: polyesters such as polyethylene terephthalate (PET); polysulfone, polyphenylene oxide, polyimide, polycarbonate, polyamide and the like. Among these, polyesters are preferable and polyethylene terephthalate is especially preferable.

The thickness of the transparent support described above has no specific limitation thereon, but is preferably in a range from 50 to 200 $\mu$m from the viewpoint of handling.

A highly glossy non-transparent support preferably has a gloss value of 40% or more as measured on the surface of the side on which the colorant-receiving layer is to be provided. The gloss value is a value obtained in accordance with a method described in JIS P-8142 (Testing method for 75 degrees specular glossiness of paper and board). The following supports are specifically exemplified.

Preferable examples include: highly glossy paper supports such as baryta paper for use in art paper, coated paper, cast-coated paper, halide photograph supports and the like; highly glossy films that are made non-transparent by inclusion of white pigment or the like in plastic films (possibly subjected to surface calendering) made of polyesters such as polyethylene terephthalate (PET); cellulose esters such as nitrocellulose, cellulose acetate and cellulose acetobutyrate; polysulfone, polyphenylene oxide, polyimide, polycarbonate, polyamide and the like; or supports obtained by providing a coat layer of polyolefin including or not including white pigment on a surface of one of the above various paper supports, one of the above transparent supports or a highly glossy film containing white pigment or the like. In addition, there are preferably exemplified: a white pigment-containing foam polyester film (for example, foam PET having therein polyolefin fine particles and voids formed by expansion).

The thickness of the non-transparent support described above has no specific limitation thereon, but is preferably in a range from 50 to 300 $\mu$m.

As the support, there may be used a support that has undergone corona discharge, glow discharge, a flame treatment, ultraviolet irradiation or the like.

Now, detailed description will be given of the base paper for use in paper supports described above.

As the base paper, wood pulp is used as the main raw material and, as necessary, synthetic pulp such as polypropylene or synthetic fibers such as nylon and polyester are mixed with the wood pulp before sheet forming. As pulps described above, there can be used any of LBKP, LBSP, NBKP, NBSP, LDP, NDP, LUKP and NUKP. Among these, it is preferable to use LBKP, NBSP, LBSP, NDP and LDP, which have more short fibers.

A proportion of LBSP and/or LDP is preferably not less than 10 mass % and not more than 70 mass %.

As the pulp, preferably used are chemical pulps (such as sulfate pulps and sulfite pulps) with less impurities, and pulps improved in whiteness by bleaching are useful. The following can be suitably added to the base paper: sizing agents such as higher fatty acids, alkylketene dimer and the like; white pigments such as calcium carbonate, talc, titanium oxide and the like; paper reinforcing agents such as starch, polyacrylamide, polyvinyl alcohol and the like; fluorescent whitening agents; water retainers such as polyethylene glycol and the like; dispersants; and softening agents such as quaternary ammonium compounds and the like.

A freeness of the pulp used in sheet forming is preferably in a range from 200 to 500 ml by CSF standards, and lengths of fibers after beating are such that the sum of retained fibers on a No.24 mesh screen in mass % and retained fibers on a No. 42 mesh screen in mass % as defined in JIS P-8207 is preferably in a range from 30 to 70%. Note that retained fibers on the No. 24 mesh screen are preferably 20 mass % or less.

Basis weight of the base paper is preferably in a range from 30 to 250 g and especially preferably in a range from 50 to 200 g. The thickness of the base paper is preferably in a range from 40 to 250 $\mu$m. The base paper can also be provided with a high smoothness by calendering during or after sheet forming. The base paper bulk density is generally in a range from 0.7 to 1.2 g/m$^2$ (JIS P-8118).

The stiffness of the base paper is preferably in a range from 20 to 200 g under conditions defined in JIS P-8143.

A surface sizing agent may be applied on the surface of the base paper. As the surface sizing agent, there can be used sizing agents of the same types as those capable of being incorporated into the base paper as above.

The pH value of the base paper is preferably in a range from 5 to 9 as measured by a hot water extraction method defined in JIS P-8113.

Polyethylene covering the front and back surfaces of the base paper is mainly low density and/or high density polyethylene (LDPE/HDPE). Other than these, linear low density polyethylene (LLDPE), polypropylene and the like can also be used in part.

Especially, a polyethylene layer on the side on which the colorant-receiving layer is to be formed is preferably a polyethylene layer improved in degrees of non-transparency and whiteness by incorporating titanium oxide of a rutile type or an anatase type into the polyethylene. Here, a content of titanium oxide is preferably in a range about from 3 to 20 mass % and more preferably in a range from 4 to 13 mass % relative to the mass of polyethylene.

Polyethylene-coated paper can be used not only as glossy paper, but also as paper with a mat or silk-finish surface, as is provided on ordinary photographic printing paper, by the polyethylene undergoing a so-called dying process during melt extrusion before coating thereof onto the surface of the base paper.

According to the present invention, as described above, density, sharpness and glossiness of a print image can be improved and curling can be suppressed without reducing other performance aspects with regard to ink. Moreover, with a colorant-receiving layer including inorganic pigment fine particles and having a three-dimensional network structure with a void percentage in a range from 50 to 80%, the colorant-receiving layer not only exhibits good ink absorptivity and can form a high resolution, high density print image thereon, but can also ensure excellent ink-receiving performance so that bleeding over time in a high temperature, high humidity environment is suppressed, and the formed print image exhibits high lightfastness and high water resistance.

EXAMPLES

Description will now be given of the present invention with Examples, but the present invention is not limited to the Examples. Note that the term "part" or "parts" and the symbol % express "mass part", "mass parts" and "mass %", respectively, unless otherwise specified, that a numeral following the mark "WM" expresses "weight-average molecular weight", and that a "polymerization degree" expresses "weight-average polymerization degree".

Example 1

Preparation of Support

After corona discharge was applied to an art paper sheet having a basis weight of 186 g/m$^2$ (made by Oji Paper Co., Ltd. under the trade name OK Kin-Fuji), high density polyethylene was coated thereon using a melt extruder to a thickness of 19 $\mu$m to form a resin layer having a mat surface (this surface of the resin layer is hereinafter referred to as a "back surface"). The resin layer at the back surface side underwent further corona discharge, which was followed by application of a dispersion, obtained by dispersing aluminum oxide (made by Nissan Chemical Industries, Ltd. under the trade name Alumina Sol 100) and silicon oxide (made by Nissan Chemical Industries, Ltd. under the trade name Snowtex O) at a ratio 1 to 2 (in mass ratio) into water, to a dry mass of 0.2 g/m$^2$ as an antistatic agent.

Then, corona discharge was applied to a felt surface (a front surface) side not provided with the resin layer. Then low density polyethylene with a melt flow rate (MFR) of 3.8 and including 10% anatase type titanium oxide, a trace of ultramarine blue and 0.01% (relative to the total mass of polyethylene) of a fluorescent whitening agent was melt extruded using a melt extruder to a thickness of 24 $\mu$m to form a highly glossy thermoplastic resin layer on the front surface side of the substrate paper (hereinafter this highly glossy surface is referred to as the "front surface"), and this was used as a support. The front surface of the support was treated by corona discharge prior to application of a coating liquid.

Preparation of Colorant-receiving Layer Coating Liquid

In the following composition, vapor-phase-process silica fine particles (1) were mixed into ion-exchanged water (2) and monomethyldiallylammonium chloride was further mixed into the ion-exchanged water. This mixture was treated twice using a NANOMERGER LA31 (made by Nanomerger K.K.) under a pressure of 500 kg/m$^2$, followed by stirring for 60 min. Then an 8% polyvinylalcohol aqueous solution (4) was added while stirring, followed by further addition of a 10% EMULGEN 109P aqueous solution (5) and diethyleneglycol monobutyl ether (6) into the mixture, to form a colorant-receiving layer coating liquid A with a pH value of 3.5. A mass ratio of silica fine particles to the water-soluble resin (PB ratio: (1)/(5)) was 4.5 to 1.

[Composition of Colorant-receiving layer Coating liquid]

| | | |
|---|---|---|
| (1) | vapor-phase-process silica fine particles (inorganic pigment fine particles) (with a specific surface area as measured by the BET method of 300 m$^2$/g and a mean primary particle diameter of 7 nm, made by Tokuyama Corp. under the trade name QS-30) | 7.7 parts |
| (2) | ion-exchanged water | 68.8 parts |
| (3) | monomethyldiallylammonium chloride (a cationic resin made by Nittobo K.K. under the trade name PASM-1, having WM 20,000 and a solid matter concentration of 60%) | 0.6 parts |
| (4) | 8% polyvinylalcohol aqueous solution (made by Kuraray Co., Ltd. under the trade name PVA 124, having a saponification degree of 98.5% and a polymerization degree of 2,400) | 21.3 parts |
| (5) | polyoxyethylenelauryl ether (a nonionic surfactant made by Kao Corp. under the trade name Emulgen 109P (10%)) | 1.0 part |
| (6) | diethyleneglycol monobutyl ether (DEGMBE) (a high boiling point organic solvent) | 0.6 parts |

Preparation of Inkjet Recording Sheet

The colorant-receiving layer coating liquid A obtained from the above process was applied to the front surface of the support using an extrusion die coater to a coating amount of 200 ml/m$^2$ (a coating step) and the coat film was dried using a hot air dryer at 80° C. with an air speed of from 3 to 8 m/sec such that a solid matter concentration in the coat layer was reduced to 20%. The coat layer showed a constant drying rate during this drying period. Directly thereafter, the support was immersed into a cross-linking agent solution A with the following composition for about 30 sec, causing the cross-linking solution A to be attached onto the coat layer to an additional coating weight of 20 g/m$^2$ (a cross-linking agent solution adding step), followed by further drying for 10 min at 80° C. (a drying step). Thus, an inkjet recording sheet (1) of the present invention on which a colorant-receiving layer with a dry film thickness of 32 $\mu$m was formed was prepared. The pH value of the cross-linking agent solution A was 9.5.

[Composition of Cross-Linking Agent Solution A]

| | |
|---|---|
| boric acid | 2.5 parts |
| ion-exchanged water | 69.5 parts |
| 10% polyallylamine aqueous solution (an organic mordant with WM 10,000) | 25 parts |
| polyoxyethylenelauryl ether (a nonionic surfactant) (made by Kao Corp. under the trade name Emulgen 109P (10%)) | 2 parts |
| ammonium chloride | 1 part |

Example 2

An inkjet recording sheet (2) of the present invention was prepared in a manner similar to Example 1 except that the colorant-receiving layer coating liquid A of Example 1 was replaced with a colorant-receiving layer coating solution B of the following composition, with a pH value of 4.0.

[Composition of Colorant-receiving layer Coating Liquid B]

| | | |
|---|---|---|
| (1) | vapor-phase-process silica fine particles (inorganic pigment fine particles) (with a specific surface area as measured by the BET method of 220 m$^2$/g and a mean primary particle diameter of 20 nm, made by Tokuyama Corp. under the trade name QS-20) | 7.7 parts |
| (2) | ion-exchanged water | 68.8 parts |
| (3) | monomethyldiallylammonium chloride (a cationic resin made by Nittobo K.K. under the trade name PASM-1, having WM 20,000 and a solid matter concentration of 60%) | 0.6 parts |
| (4) | 8% polyvinylalcohol aqueous solution (made by Kuraray Co., Ltd. under the trade name PVA 124, having a saponification degree of 98.5% and a polymerization degree of 2,400) | 21.3 parts |
| (5) | polyoxyethylenelauryl ether (a nonionic surfactant made by Kao Corp. under the trade name Emulgen 109P (10%)) | 1.0 part |
| (6) | diethyleneglycol monobutyl ether (DEGMBE) (a high boiling point organic solvent) | 0.6 parts |

Example 3

An inkjet recording sheet (3) of the present invention was prepared in a manner similar to Example 1 except that the colorant-receiving layer coating liquid A of Example 1 was replaced with a colorant-receiving layer coating solution C of the following composition, with a pH value of 2.9.

[Composition of Colorant-receiving layer Coating Liquid C]

| | | |
|---|---|---|
| (1) | vapor-phase-process silica fine particles (inorganic pigment fine particles) (with a specific surface area as measured by the BET method of 300 m$^2$/g and a mean primary particle diameter of 7 nm, made by Tokuyama Corp. under the trade name QS-30) | 7.7 parts |
| (2) | ion-exchanged water | 68.8 parts |
| (3) | monomethyldiallylammonium chloride (a cationic resin made by Nittobo K.K. under the trade name PASM-1, having WM 20,000 and a solid matter concentration of 60%) | 0.6 parts |

-continued

| [Composition of Colorant-receiving layer Coating Liquid C] | |
|---|---|
| (4) 8% polyvinylalcohol aqueous solution (made by Unitika Ltd. under the trade name UF 250MG, having a saponification degree of 96.1% and a polymerization degree of 2,500) | 21.3 parts |
| (5) polyoxyethylenelauryl ether (a nonionic surfactant made by Kao Corp. under the trade name Emulgen 109P (10%)) | 1.0 part |
| (6) diethyleneglycol monobutyl ether (DEGMBE) (a high boiling point organic solvent) | 0.6 parts |

Example 4

An inkjet recording sheet (4) of the present invention was prepared in a manner similar to Example 1 except that the colorant-receiving layer coating liquid A of Example 1 was replaced with a colorant-receiving layer coating solution D of the following composition, with a pH value of 4.6.

| [Composition of Colorant-receiving layer Coating Liquid D] | |
|---|---|
| (1) vapor-phase-process silica fine particles (inorganic pigment fine particles) (with a specific surface area as measured by the BET method of 300 $m^2/g$ and a mean primary particle diameter of 7 nm, made by Tokuyama Corp. under the trade name QS-30) | 7.7 parts |
| (2) ion-exchanged water | 68.8 parts |
| (3) monomethyldiallylammonium chloride (a cationic resin made by Nittobo K.K. under the trade name PASM-1, having WM 20,000 and a solid matter concentration of 60%) | 0.6 parts |
| (4) 8% polyvinylalcohol aqueous solution (made by Kuraray Co., Ltd. under the trade name PVA 124, having a saponification degree of 98.5% and a polymerization degree of 2,400) | 21.3 parts |
| (5) 10% Anon BL aqueous solution (an amphoteric surfactant made by Nissan K.K.) | 1.0 part |
| (6) diethyleneglycol monobutyl ether (DEGMBE) (a high boiling point organic solvent) | 0.6 parts |

Example 5

An inkjet recording sheet (5) of the present invention was prepared in a manner similar to Example 1 except that 25% aqueous ammonia was added to the colorant-receiving layer coating liquid A of Example 1 to adjust the pH value to 4.6, and the cross-linking agent solution A was replaced with a cross-linking agent solution E of the following composition, with a pH value of 9.5.

| [Composition of Cross-Linking Agent Solution E] | |
|---|---|
| boric acid (a cross-linking agent) | 1.5 parts |
| ion-exchanged water | 86.5 parts |
| 20% polyallylamine aqueous solution (an organic mordant with WM 5,000) | 10 parts |
| polyoxyethylenelauryl ether (a nonionic surfactant) (made by Kao Corp. under the trade name Emulgen 109P (10%)) | 2 parts |

Example 6

An inkjet recording sheet (6) of the present invention was prepared in a manner similar to Example 1 except that the colorant-receiving layer coating liquid A of Example 1 was replaced with a colorant-receiving layer coating solution F of the following composition, with a pH value of 2.9.

| [Composition of Colorant-receiving layer Coating Liquid F] | |
|---|---|
| (1) vapor-phase-process silica fine particles (inorganic pigment fine particles) (with a specific surface area as measured by the BET method of 300 $m^2/g$ and a mean primary particle diameter of 7 nm, made by Tokuyama Corp. under the trade name QS-30) | 7.7 parts |
| (2) ion-exchanged water | 68.8 parts |
| (3) monomethyldiallylammonium chloride (a cationic resin made by Nittobo K.K. under the trade name PASM-1, having WM 20,000 and a solid matter concentration of 60%) | 0.6 parts |
| (4) 8% polyvinylalcohol aqueous solution (made by Kuraray Co., Ltd. under the trade name PVA 120, having a saponification degree of 98.5% and a polymerization degree of 2,000) | 21.3 parts |
| (5) polyoxyethylenelauryl ether (a nonionic surfactant made by Kao Corp. under the trade name Emulgen 109P (10%)) | 1.0 part |
| (6) diethyleneglycol monobutyl ether (DEGMBE) (a high boiling point organic solvent) | 0.6 parts |

Example 7

An inkjet recording sheet (7) of the present invention was prepared in a manner similar to Example 1 except that the cross-linking agent solution A of Example 1 was changed to a cross-linking agent solution G of the following composition, with a pH value of 9.2.

| [Composition of Cross-Linking Agent Solution G] | |
|---|---|
| boric acid (a cross-linking agent) | 2.5 parts |
| ion-exchanged water | 69.0 parts |
| 10% polyallylamine aqueous solution (an organic mordant with WM 20,000) | 25 parts |
| ammonium thiocyanate | 1.5 parts |
| polyoxyethylenelauryl ether (a nonionic surfactant) (made by Kao Corp. under the trade name Emulgen 109P (10%)) | 2 parts |

Example 8

An inkjet recording sheet (8) of the present invention was prepared in a manner similar to Example 1 except that the cross-linking agent solution A of Example 1 was replaced with a cross-linking agent solution H of the following composition, with a pH value of 8.8.

| [Composition of Cross-Linking Agent Solution H] | |
|---|---|
| boric acid (a cross-linking agent) | 2.5 parts |
| ion-exchanged water | 69.0 parts |
| 10% monomethyldiallylammonium chloride aqueous solution (an organic mordant with a WM = 20,000) | 25 parts |
| ammonium thiocyanate | 1.5 parts |
| polyoxyethylenelauryl ether (a nonionic surfactant) (made by Kao Corp. under the trade name Emulgen 109P (10%)) | 2 parts |

Example 9

An inkjet recording sheet (9) of the present invention was prepared in a manner similar to Example 1 except that the colorant-receiving layer coating liquid A and the cross-linking agent solution A of Example 1 were replaced with a colorant-receiving layer solution I with a pH value of 2.6 and a cross-linking agent solution I with a pH value of 9.5 of the following compositions, respectively.

[Composition of Colorant-receiving layer Coating Liquid I]

| | | |
|---|---|---|
| (1) | vapor-phase-process silica fine particles (inorganic pigment fine particles) (with a specific surface area as measured by a BET method of 300 $m^2/g$ and a mean primary particle diameter of 7 nm, made by Tokuyama Corp. under the trade name QS-30) | 7.7 parts |
| (2) | ion-exchanged water | 68.8 parts |
| (3) | polyamidine (a cationic resin made by HYMO Co., Ltd. under the trade name Modified SC700, having WM 6,000 and a solid matter concentration of 30%) | 0.6 parts |
| (4) | 8% polyvinylalcohol aqueous solution (made by Kuraray Co., Ltd. under the trade name PVA 124, having a saponification degree of 98.5% and a polymerization degree of 2,400) | 21.3 parts |
| (5) | polyoxyethylenelauryl ether (a nonionic surfactant made by Kao Corp. under the trade name Emulgen 109P (10%)) | 1.0 part |
| (6) | diethyleneglycol monobutyl ether (DEGMBE) (a high boiling point organic solvent) | 0.6 parts |

[Composition of Cross-Linking Agent Solution I]

| | |
|---|---|
| boric acid (a cross-linking agent) | 2.5 parts |
| ion-exchanged water | 69.0 parts |
| 10% polyallylamine aqueous solution (an organic mordant with WM 10,000) | 25 parts |
| ammonium thiocyanate | 1.5 parts |
| polyoxyethylenelauryl ether (a nonionic surfactant) (made by Kao Corp. under the trade name Emulgen 109P (10%)) | 2 parts |

Example 10

An inkjet recording sheet (10) of the present invention was prepared in a manner similar to Example 1 except that the cross-linking agent solution A of Example 1 was replaced with a cross-linking agent solution J of the following composition, with a pH value of 9.2.

[Composition of Cross-Linking Agent Solution J]

| | |
|---|---|
| boric acid (a cross-linking agent) | 2.5 parts |
| ion-exchanged water | 69.0 parts |
| 10% polyallylamine-acrylonitrile adduct aqueous solution (an organic mordant at 5 mol % with WM 20,000) | 25 parts |
| ammonium thiocyanate | 1.5 parts |
| polyoxyethylenelauryl ether (a nonionic surfactant) (made by Kao Corp. under the trade name Emulgen 109P (10%)) | 2 parts |

Comparative Example 1

In the following composition, vapor-phase-process silica fine particles were mixed into ion exchanged water, and the mixture was dispersed for 20 min using a high speed rotary colloid mill (made by M technique Co., Ltd. under the trade name Kurea-mix) at 10,000 rpm. Thereafter, a 9% polyvinylalcohol aqueous solution described below was added to the dispersion, followed by re-dispersion in the same conditions as described above, and the pH value of the dispersion was adjusted to 9.5 with 25% aqueous ammonia, thus preparing a comparative colorant-receiving layer coating liquid A.

[Composition of Comparative Colorant-receiving layer Coating Liquid A]

| | | |
|---|---|---|
| (1) | vapor-phase-process silica fine particles (inorganic pigment fine particles) (with a specific surface area as measured by the BET method of 300 $m^2/g$ and a mean primary particle diameter of 7 nm, made by Nippon Aerosil K.K. under the trade name Aerosil-300) | 9.9 parts |
| (2) | ion-exchanged water | 53.3 parts |
| (3) | 9% polyvinylalcohol aqueous solution (made by Kuraray Co., Ltd. under the trade name PVA 420, having a saponification degree of 80.0% and a polymerization degree of 2,000) | 31.4 parts |
| (4) | 10% F-144D aqueous solution (a nonionic surfactant made by Dainippon Ink and Chemicals, Incorporated) | 5 parts |
| (5) | 2.5% aqueous ammonia | 0.4 parts |

The comparative colorant-receiving layer coating liquid A obtained from the above process was applied on the front surface of a support (obtained in a similar manner to Example 1), using an extrusion die coater, to a coating amount of 200 $ml/m^2$ (a coating step). The coated film was dried using a hot air dryer at 80° C. with an air speed of from 3 to 8 m/sec such that a solid matter concentration in the coat layer was reduced to 20%. The coat layer showed a constant drying rate during this drying period. Directly thereafter, the support was immersed into a comparative cross-linking agent solution A of the following composition, with a pH value of 9.4, for about 30 sec to cause the comparative cross-linking agent solution A to be attached onto the coat layer to an additional coating weight of 20 $g/m^2$ (a cross-linking solution adding step), followed by further drying for 10 min at 80° C. (a drying step). Thus, a comparative inkjet recording sheet (1), on which a colorant-receiving layer of a dry film thickness of 32 $\mu$m was formed, was prepared.

[Composition of comparative cross-linking agent solution A]

| | |
|---|---|
| boric acid (concentration 6%, a cross-linking agent) | 1.5 parts |
| ion-exchanged water | 86.5 parts |
| 20% polyallylamine aqueous solution (an organic mordant with WM 5,000) | 10 parts |
| 10% F-144D aqueous solution (a nonionic surfactant made by Dainippon Ink and Chemicals, Incorporated) | 2 parts |

Comparative Example 2

In the method of Example 1, after the colorant-receiving layer coating liquid A was prepared, the pH value of the colorant-receiving layer coating liquid A was adjusted to 6.0 using 25% aqueous ammonia. Consequently, the colorant-receiving layer coating liquid A was gelated, and therefore no application was effected on the surface of a support therewith.

Comparative Example 3

An inkjet recording sheet (3) for comparison was prepared in a manner similar to Example 1 except that the colorant-receiving layer coating liquid A of Example 1 was replaced with a comparative colorant-receiving layer coat ng liquid C of the following composition, with a pH value of 3.6.

| [Composition of Comparative Colorant-receiving layer Coating Liquid C] | |
|---|---|
| (1) vapor-phase-process silica fine particles (inorganic pigment fine particles) (with a specific surface area as measured by the BET method of 300 $m^2/g$ and a mean primary particle diameter of 7 nm, made by Tokuyama Corp. under the trade name QS-30) | 7.7 parts |
| (2) ion-exchanged water | 69.4 parts |
| (3) monomethyldiallylammonium chloride (a cationic resin made by Nittobo K.K. under the trade name PASM-1, having WM 20,000 and a solid matter concentration of 60%) | 0.6 parts |
| (4) 8% polyvinylalcohol aqueous solution (made by Kuraray Co., Ltd. under the trade name PVA 124, having a saponification degree of 98.5% and a polymerization degree of 2,400) | 21.3 parts |
| (5) 10% YUTAMIN 24P aqueous solution (a cationic surfactant made by Kao Corp.) | 1.0 part |

Comparative Example 4

A comparative inkjet recording sheet (4) was prepared in a manner similar to Example 1 except that the colorant-receiving layer coating liquid A of Example 1 was replaced with a comparative colorant-receiving layer coating liquid D of the following composition, with a pH value of 2.9.

| [Composition of Comparative Colorant-receiving layer Coating Liquid D] | |
|---|---|
| (1) vapor-phase-process silica fine particles (inorganic pigment fine particles) (with a specific surface area as measured by the BET method of 300 $m^2/g$ and a mean primary particle diameter of 7 nm, made by Tokuyama Corp. under the trade name QS-30) | 7.7 parts |
| (2) ion-exchanged water | 69.4 parts |
| (3) monomethyldiallylammonium chloride (a cationic resin made by Nittobo K.K. under the trade name PASM-1, having WM 20,000 and a solid matter concentration of 60%) | 0.6 parts |
| (4) 8% polyvinylalcohol aqueous solution (made by Kuraray Co., Ltd. under the trade name PVA 217, having a saponification degree of 88.0% and a polymerization degree of 1,700) | 21.3 parts |
| (5) polyoxyethylenelauryl ether (a nonionic surfactant made by Kao Corp. under the trade name Emulgen 109P (10%)) | 1.0 part |

Comparative Example 5

A comparative inkjet recording sheet (5) was prepared in a manner similar to Example 1 except that the colorant-receiving layer coating liquid A of Example 1 was replaced with a comparative colorant-receiving layer coating liquid E of the following composition, with a pH value of 2.9.

| [Composition of Comparative Colorant-receiving layer Coating Liquid E] | |
|---|---|
| (1) vapor-phase-process silica fine particles (inorganic pigment fine particles) (with a specific surface area as measured by the BET method of 300 $m^2/g$ and a mean primary particle diameter of 7 nm, made by Tokuyama Corp. under the trade name QS-30) | 7.7 parts |

-continued

| [Composition of Comparative Colorant-receiving layer Coating Liquid E] | |
|---|---|
| (2) ion-exchanged water | 69.4 parts |
| (3) monomethyldiallylammonium chloride (a cationic resin made by Nittobo K.K. under the trade name PASM-1, having WM 20,000 and a solid matter concentration of 60%) | 0.6 parts |
| (4) 8% polyvinylalcohol aqueous solution (made by Kuraray Co., Ltd. under the trade name PVA 217, having a saponification degree of 88.0% and a polymerization degree of 1,700) | 21.3 parts |

Comparative Example 6

A comparative inkjet recording sheet (6) was prepared in a manner similar to Example 1 except that in the colorant-receiving layer coating liquid A of Example 1, the polyallylamine of the cross-linking agent solution (A) with a WM of 10,000 was replaced with a polyallylamine with a WM of 40,000 and the diethyleneglycol monobutyl ether (DEGMBE, the high boiling point organic solvent) was omitted.

Comparative Example 7

A comparative inkjet recording sheet (7) was prepared in a manner similar to Example 1 except that the colorant-receiving layer coating liquid A of Example 1 was replaced with a comparative colorant-receiving layer coating liquid G of the following composition, with a pH value of 4.6.

| [Composition of Comparative Colorant-receiving layer Coating Liquid G] | |
|---|---|
| (1) vapor-phase-process silica fine particles (inorganic pigment fine particles) (with a specific surface area as measured by the BET method of 140 $m^2/g$ and a mean primary particle diameter of 40 nm, made by Tokuyama Corp. under the trade name QS-10) | 7.7 parts |
| (2) ion-exchanged water | 69.4 parts |
| (3) monomethyldiallylammonium chloride (a cationic resin made by Nittobo K.K. under the trade name PASM-1, having WM 20,000 and a solid matter concentration of 60%) | 0.6 parts |
| (4) 8% polyvinylalcohol aqueous solution (made by Kuraray Co., Ltd. under the trade name PVA 124, having a saponification degree of 98.5% and a polymerization degree of 2,400) | 21.3 parts |
| (5) polyoxyethylenelauryl ether (a nonionic surfactant made by Kao Corp. under the trade name Emulgen 109P (10%)) | 1.0 part |

Performance Evaluation

Each of the following evaluations was individually performed on the inkjet recording sheets (1) to (10) of the present invention and the comparative inkjet recording sheets (1) to (7) obtained by the above processes. Evaluation results are shown in Table 1.

Glossiness

A 60 degree gloss value on the inkjet recording sheet prior to printing was measured with a digital variable-angle glossmeter (made by Suga Test Instrument Co. Ltd. under the trade name USG-50DP).

Ink Absorption Rate

Solid print images in the colors Y (yellow), M (magenta) C (cyan), K (black), B (blue), G (green) and R (red) were formed on the colorant-receiving layers of the respective inkjet recording sheets using an inkjet printer (made by Seiko Epson Corporation under the trade name PM-900C). A paper sheet was put into contact with and pressed onto each print image, and then evaluation was performed according to the following criteria on the basis of a degree of transfer of ink onto the paper sheet.

Criteria

AA: no transfer of ink onto paper was observed: a good ink absorption rate.

BB: little transfer of ink onto paper was observed.

CC: partial transfer of ink onto paper was observed.

Water Resistance

Solid print images in the colors Y (yellow), M (magenta) C (cyan), K (black), B (blue), G (green) and R (red) were formed on the colorant-receiving layers of the respective inkjet recording sheets using an inkjet printer similar to the inkjet printer used in the ink absorption rate evaluation. Each print image was left as is for 3 hours, and then immersed in water for 1 min, followed by visual evaluation on a degree of flowing-out of ink according to the following criteria.

Criteria

AA: no flowing-out of dye was observed.

BB: flowing-out of dye was generally observed, with a gradual reduction in color density of the print image.

CC: flowing-out of almost all of the dye into the water was observed.

Bleeding Over Time

Magenta ink and black ink were printed in respective lattice line patterns with line widths of 0.28 mm side by side on each inkjet recording sheet using the same printer as in the measurement of the ink absorption rate. The print image was left as is for 3 hours, and thereafter stored in a thermohygrostat under conditions of temperature 40° C. and relative humidity 90% for 3 days, followed by measurement of line widths in the black pattern to obtain an evaluation of bleeding over time. Note that the smaller the line width, the less the bleeding over time was.

Ozone Fading Test

A print image in C (cyan) was formed on the colorant-receiving layer of the inkjet recording sheet using an inkjet printer (made by Seiko Epson Corporation under the trade name PM-900C), followed by leaving the print image in a 4 ppm ozone atmosphere for 6 hours as an ozone treatment. For evaluation, a survival ratio (100y/x) was calculated from cyan concentrations before and after the treatment.

Curling

The inkjet recording sheet was cut into a sheet of the international standard size A6 and the cut sheet was left on a flat test board in an environment with conditions of temperature 10° C. and relative humidity 30% for 1 hour, followed by measurement of heights of the four corners of the cut sheet above the test board, and calculation of the average thereof as a curling value.

Print Image Density

A solid print image in K (black) was formed on the inkjet recording sheet using an inkjet printer (made by Seiko Epson Corporation under the trade name PM-900C and left as is for 3 hours, followed by measurement of reflection density on the printed surface using an X-RITE density meter.

TABLE 1

| | Gloss values (%) | Ink absorption rates | Water resistance | Bleeding over time | Ozone fading (%) | Curling (mm) | Print density |
|---|---|---|---|---|---|---|---|
| Example 1 | 57 | AA | AA | 0.31 | 81 | 4 | 2.47 |
| Example 2 | 46 | AA | AA | 0.33 | 77 | 3 | 2.25 |
| Example 3 | 55 | AA | AA | 0.30 | 80 | 5 | 2.35 |
| Example 4 | 53 | AA | AA | 0.35 | 79 | 5 | 2.40 |
| Example 5 | 52 | AA | AA | 0.37 | 83 | 3 | 2.41 |
| Example 6 | 47 | AA | AA | 0.38 | 82 | 2 | 2.35 |
| Example 7 | 56 | AA | AA | 0.32 | 89 | 7 | 2.33 |
| Example 8 | 56 | AA | AA | 0.38 | 87 | 7 | 2.48 |
| Example 9 | 47 | AA | AA | 0.36 | 89 | 6 | 2.32 |
| Example 10 | 58 | AA | AA | 0.32 | 97 | 4 | 2.49 |
| Comparative Example 1 | 40 | AA | AA | 0.41 | 59 | 5 | 1.90 |
| Comparative Example 2 | — | — | — | — | — | — | — |
| Comparative Example 3 | 39 | AA | BB | 0.65 | 51 | 14 | 2.11 |
| Comparative Example 4 | 33 | AA | BB | 0.52 | 53 | 16 | 2.05 |
| Comparative Example 5 | 31 | AA | BB | 0.51 | 55 | 20 | 2.06 |
| Comparative Example 6 | 80 | CC | CC | 0.54 | 45 | 13 | 1.99 |
| Comparative Example 7 | 27 | BB | BB | 0.55 | 47 | 12 | 1.98 |

It is seen from the results shown in Table 1 that the inkjet recording sheets of the present invention are excellent in glossiness, ink absorption rate, water resistance, bleeding over-time, ozone fading resistance, anti-curling and print density of a print image thereon. Thus, it is understood that a print image formed thereon will be excellent in print density, sharpness and glossiness of the image, and further, excellent in transportability because of a high flatness due to a low curling value. In addition, the inkjet recording sheets (7) to (10), in which an ozone fading preventive agent was contained, were excellent in ozone fading resistance.

In contrast, the comparative inkjet recording sheets (1) to (7), in which neither a cationic resin nor an ozone fading preventive agent was contained, were inferior in every category of glossiness, ink absorption rate, water resistance, bleeding over time, ozone fading resistance, anti-curling and print density.

The present invention can provide an inkjet recording sheet excellent in density, sharpness and glossiness of a print image, and further, with little curling and therefore flat and excellent in printer transportability. In addition, the present invention can provide an inkjet recording sheet that is strong and stiff without cracking or other inconveniences, having a good ink absorptivity and capable of forming a high resolution image. Still further, the present invention can provide an inkjet recording sheet extremely excellent in bleeding over time, water resistance, and ozone fading resistance, and further, showing a high lightfastness even under irradiation with solar rays and fluorescent lamp light.

What is claimed is:

1. An inkjet recording sheet comprising a support and, on a surface of the support, a colorant-receiving layer formed by:

applying a first coating liquid, which has a pH value of at most 5 and is obtained by adding a solution that includes polyvinyl alcohol, a high boiling point organic solvent and at least one of a first nonionic surfactant and an amphoteric surfactant, to a dispersion that includes vapor-phase-process silica having a specific surface area of at least 200 $m^2/g$ as measured by the BET method and a cationic resin, to form a coat layer;

adding, to the coat layer formed by the application of the first coating liquid, a second coating liquid, which has a pH value of at least 8.5 or higher and includes a cross-linking agent capable of cross-linking the polyvinyl alcohol, an organic mordant and a second nonionic surfactant, either at the same time as the application of the first coating liquid or during drying of the coat layer of the first coating liquid but before the coat layer shows a decreasing rate of drying; and thereafter allowing the coated layer, to which the second coating liquid has been added, to harden and dry for forming a porous structure.

2. An inkjet recording sheet according to claim 1, wherein the pH value of the first coating liquid is 3.7 or lower and the pH value of the second coating liquid is 9.2 or higher.

3. An inkjet recording sheet according to claim 1, wherein the vapor-phase-process silica comprises a mean primary particle diameter of 30 nm or less.

4. An inkjet recording sheet according to claim 1, wherein the polyvinyl alcohol comprises a polyvinyl alcohol selected from the group consisting of polyvinyl alcohols, cation-modified polyvinyl alcohols, anion-modified polyvinyl alcohols, silanol-modified polyvinyl alcohols and polyvinyl alcohol derivatives.

5. An inkjet recording sheet according to claim 1, wherein the polyvinyl alcohol comprises a weight average polymerization degree of at least 1,800 and a saponification degree of at least 90%.

6. An inkjet recording sheet according to claim 1, wherein the polyvinyl alcohol comprises a content amount thereof in the colorant-receiving layer of from 9 to 40 mass % relative to total solid matter mass of the colorant-receiving layer.

7. An inkjet recording sheet according to claim 1, wherein the vapor-phase-process silica in the colorant-receiving layer comprises mass i, polyvinyl alcohol in the colorant-receiving layer comprises mass p, and the content mass ratio i:p is in a range from 1.5:1 to 10:1.

8. An inkjet recording sheet according to claim 1, wherein the cationic resin comprises a cationic resin selected from the group consisting of cationic dicyan resins, cationic polyamine resins and cationic polycation resins.

9. An inkjet recording sheet according to claim 1, wherein the cationic resin comprises monomethyldiallylammonium chloride.

10. An inkjet recording sheet according to claim 1, wherein the cationic resin comprises a content thereof in the colorant-receiving layer in a range from 1 to 30 mass parts relative to 100 mass parts of the vapor-phase-process silica.

11. An inkjet recording sheet according to claim 1, wherein the first and second nonionic surfactants comprise a surfactant selected from the group consisting of polyoxyalkylenealkyl ethers, polyoxyalkylenealkyl phenyl ethers, oxyethylene/oxypropylene block copolymers, sorbitan fatty acid esters, polyoxyethylenesorbitan fatty acid esters, polyoxyethylenesorbitol fatty acid esters, glycerine fatty acid esters, polyoxyethyleneglycerin fatty acid esters, polyoxyethylene fatty acid esters and polyoxyethylenealkyl amines.

12. An inkjet recording sheet according to claim 1, wherein the amphoteric surfactant comprises an amphoteric surfactant selected from the group consisting of amino acid type amphoteric surfactants, carboxyamnmonium betaine type amphoteric surfactants, sulfoammonium betaine type amphoteric surfactants, ammonium sulfuric ester betaine type amphoteric surfactants and imidazolium betaine type amphoteric surfactants.

13. An inkjet recording sheet according to claim 1, wherein the at least one surfactant in the first coating liquid comprises a total content amount therein in a range from 0.01 mass % to 1 mass %.

14. An inkjet recording sheet according to claim 1, wherein the high boiling point organic solvent is substantially water-soluble.

15. An inkjet recording sheet according to claim 1, wherein the high boiling point organic solvent comprises an organic solvent selected from the group consisting of ethylene glycol, propylene glycol, diethylene glycol, triethylene glycol, glycerin, diethylene glycol monobutyl ether, triethylene glycol monobutyl ether, glycerin monomethyl ether, 1,2,3-butanetriol, 1,2,4-butanetriol, 1,2,4-pentanetriol, 1,2,6-hexanetriol, thiodiglycol, triethanolamine, and polyethylene glycols with a weight average molecular weight of 400 or less.

16. An inkjet recording sheet according to claim 1, wherein the high boiling point organic solvent comprises a content amount in the first coating liquid in a range from 0.05 mass % to 1 mass %.

17. An inkjet recording sheet according to claim 1, wherein the cross-linking agent comprises a boron compound.

18. An inkjet recording sheet according to claim 1, wherein the organic mordant comprises a cationic mordant.

19. An inkjet recording sheet according to claim 1, further comprising at least one of thiourea and a thiocyanate.

20. A method for producing the inkjet recording sheet of claim 1, the method comprising the steps of:

a) preparing a solution including polyvinyl alcohol, a high boiling point organic solvent and at least one of a first nonionic surfactant and an amphoteric surfactant;

b) adding the solution to a dispersion including vapor-phase-process silica and a cationic resin for forming a first coating liquid having a pH value of at most 5, the vapor-phase-process silica including a specific surface area of at least 200 $m^2/g$ as measured by the BET method;

c) preparing a second coating liquid including a cross-linking agent capable of cross-linking the polyvinyl alcohol, an organic mordant and a second nonionic surfactant, the second coating liquid having a pH value of at least 8.5;

d) applying the first coating liquid to a surface of a support for forming a coat layer thereon;

e) after commencement of the step of applying the first coating liquid but before the coat layer shows a decreasing rate of drying during drying thereof, adding the second coating liquid to the coat layer; and f) thereafter, allowing the coated layer to harden and dry for forming a colorant-receiving layer with a porous structure.

* * * * *